US007448372B2

(12) United States Patent
Lai

(10) Patent No.: US 7,448,372 B2
(45) Date of Patent: Nov. 11, 2008

(54) SHOOTING STRUCTURE OF A PAINT BULLET GUN

(76) Inventor: Bao Shyan Lai, No. 839. Wunsin S. Rd., Nantun District, Taichung City 408 (TW)

( * ) Notice: Subject to any disclaimer, the term of this patent is extended or adjusted under 35 U.S.C. 154(b) by 366 days.

(21) Appl. No.: 11/483,620

(22) Filed: Jul. 11, 2006

(65) Prior Publication Data

US 2008/0011283 A1 Jan. 17, 2008

(51) Int. Cl.
*F41B 11/06* (2006.01)

(52) U.S. Cl. ..... 124/74; 124/71; 124/72; 124/73

(58) Field of Classification Search ..... 124/71–77
See application file for complete search history.

(56) References Cited

U.S. PATENT DOCUMENTS

| | | | | |
|---|---|---|---|---|
| 7,121,272 | B2 * | 10/2006 | Jones | 124/77 |
| 7,185,646 | B2 * | 3/2007 | Jones | 124/74 |
| 7,290,538 | B2 * | 11/2007 | Lai | 124/73 |
| 2005/0115550 | A1 * | 6/2005 | Jones | 124/65 |
| 2005/0115554 | A1 * | 6/2005 | Jones | 124/74 |
| 2006/0157043 | A1 * | 7/2006 | Jones | 124/74 |
| 2006/0162714 | A1 * | 7/2006 | Lai | 124/74 |
| 2006/0162715 | A1 * | 7/2006 | Jones | 124/74 |
| 2006/0169264 | A1 * | 8/2006 | Lai | 124/71 |
| 2006/0169265 | A1 * | 8/2006 | Lai | 124/71 |
| 2006/0207586 | A1 * | 9/2006 | Jones | 124/74 |
| 2007/0017497 | A1 * | 1/2007 | Masse | 124/73 |
| 2007/0131210 | A1 * | 6/2007 | Lai | 124/73 |
| 2007/0209650 | A1 * | 9/2007 | Jones | 124/73 |
| 2007/0215133 | A1 * | 9/2007 | Jones | 124/73 |
| 2007/0215134 | A1 * | 9/2007 | DeHaan et al. | 124/77 |

* cited by examiner

*Primary Examiner*—Troy Chambers
*Assistant Examiner*—Michael D David
(74) *Attorney, Agent, or Firm*—Rosenberg, Klein & Lee

(57) ABSTRACT

A shooting structure of a paint bullet gun, which is arranged in a passage of a gun body of the paint bullet gun. The passage communicates with a bullet-dropping port. A handle is arranged on one side of the gun body. A trigger unit is disposed in the handle. The shooting structure includes a tubular member, a gunlock and a controlling member. The tubular member is disposed in the passage near the bullet-dropping port. In the passage, a gas reservoir is defined around the tubular member. The gas reservoir communicates with a gas supply via a pipeline. The gunlock is axially movably accommodated in the tubular member. The gunlock is formed with an axial exhaust duct. The gunlock is formed with a flange, whereby a space is defined between the gunlock and the tubular member. The gas reservoir communicates with the space.

6 Claims, 6 Drawing Sheets

SHOOTING STRUCTURE OF A PAINT BULLET GUN

BACKGROUND OF THE INVENTION

The present invention is related to a shooting structure of a paint bullet gun. In the paint bullet gun, one single gas supply is used to control movement of the gunlock as well as the shooting of the paint bullet.

FIG. 6 shows a conventional shooting structures of a paint bullet gun. The barrel 6 of the paint bullet gun is formed with a passage 61 and a bullet-dropping port 63 communicating with the passage 61. One end of the passage 61 is a paint bullet exit 611. A gunlock 62 is disposed in the passage 61. The gunlock 62 respectively has a first cock 621*a* and a second cock 621*b* at a middle section and a rear section. The passage 61 has an isolating section 612 and a receiving section 613 respectively corresponding to the first and second cocks 621*a*, 621*b*. A first air chamber 614*a* and a second air chamber 614*b* are respectively formed on two sides of the isolating section 612. The barrel 6 is formed with a first intake section 64*a* and a second intake section 64*b* respectively corresponding to the first and second air chambers 614*a*, 614*b* for guiding high-pressure gas from a high-pressure gas source 65 into the first and second air chambers 614*a*, 614*b*. A trigger 66 serves to control the intake sections 64*a*, 64*b* for driving the gunlock 62 to move back and forth and shoot the paint bullet.

The gas entering the first air chamber 614*a* for retreating the gunlock 62 will be exhausted from the barrel 6 when the gunlock 62 is forwarded. Therefore, the gas is wasted. The high-pressure gas source 65 is a steel bottle reserving limited amount of high-pressure gas therein. In the case that the waste gas is saved, the number of shot paint bullet will be increased.

Moreover, the two cocks 621*a*, 621*b* occupy much room of the barrel 6 so that the barrel 6 has a considerable length. Therefore, such length is not applicable to a handgun.

Also, the two cocks 621*a*, 621*b* leads to a considerable length of the gunlock 62. Therefore, the gunlock 62 must be manufactured at high axial precision. In case of poor precision, the gunlock 62 can be hardly smoothly moved. This will affect shooting rate. In addition, under violent exercise, after a period of use, the gunlock 62 tends to deflect. As a result, the paint bullet gun will malfunction and cannot be further used.

SUMMARY OF THE INVENTION

It is therefore a primary object of the present invention to provide a shooting structure of a paint bullet gun. In the paint bullet gun, the gas reservoir communicates with the internal space of the tubular member via the flow ways. Therefore, the gas entering the gas reservoir also serves to drive the gunlock. Accordingly, one single gas supply is used to control movement of the gunlock as well as the shooting of the paint bullet. Therefore, it is no more necessary to add another gas supply for driving the gunlock. In addition, when the gunlock is moved forward, the gas is fed back to the gas reservoir. Therefore, the gas can be recovered and reused to increase the number of the shot paint bullets.

It is a further object of the present invention to provide the above shooting structure of the paint bullet gun. The guide stem of the controlling member extends into the gunlock, whereby the gunlock can axially move along the guide stem to shorten the necessary axial moving space for the gunlock. Therefore, the length of the gun body can be shortened to facilitate holding of the paint bullet gun. Such length is applicable to a handgun.

The present invention can be best understood through the following description and accompanying drawings wherein:

DETAILED DESCRIPTION OF THE PREFERRED EMBODIMENTS

Figure 1:
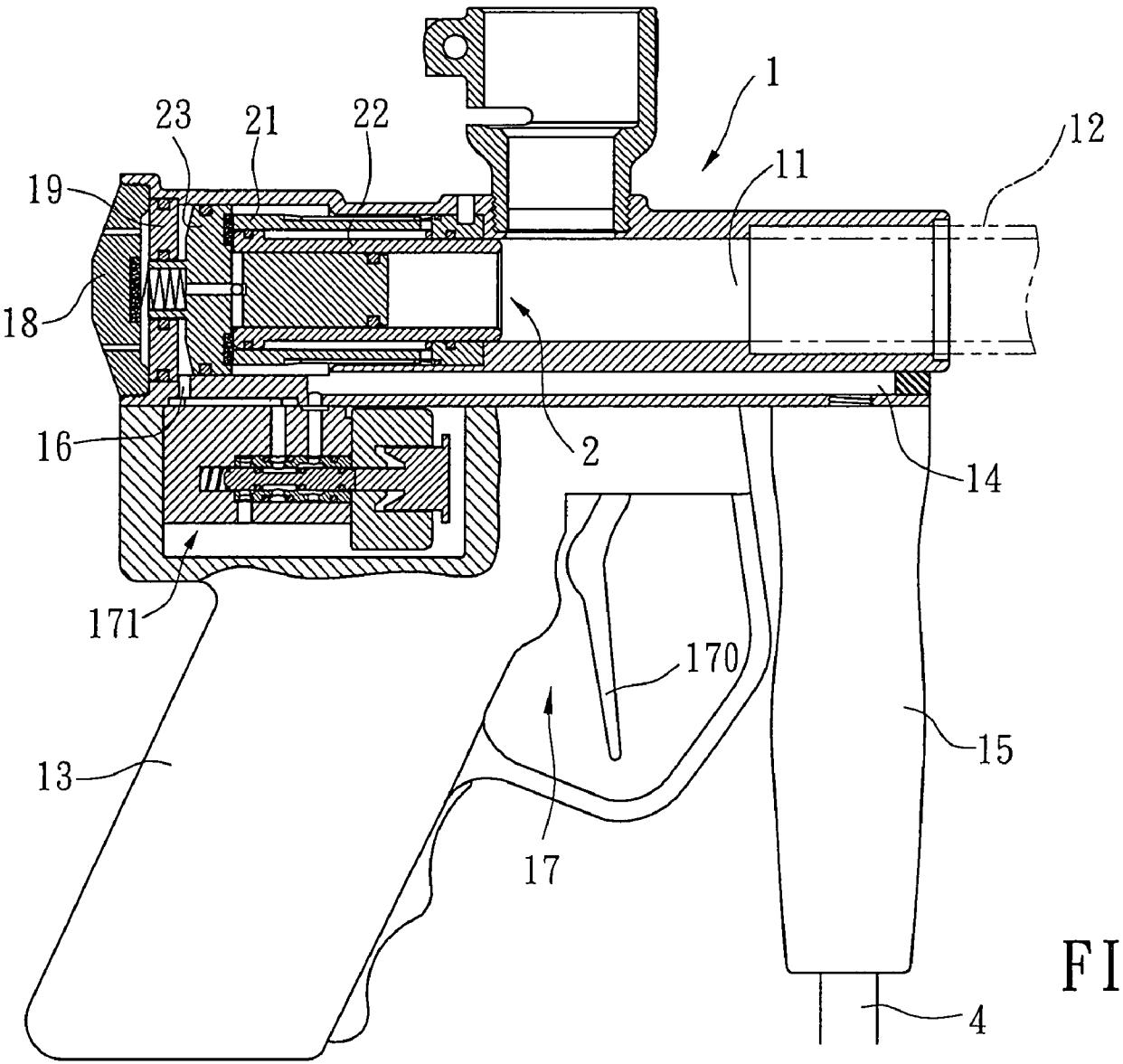
FIG. 1 is a sectional assembled view of the present invention.
Figure 2:
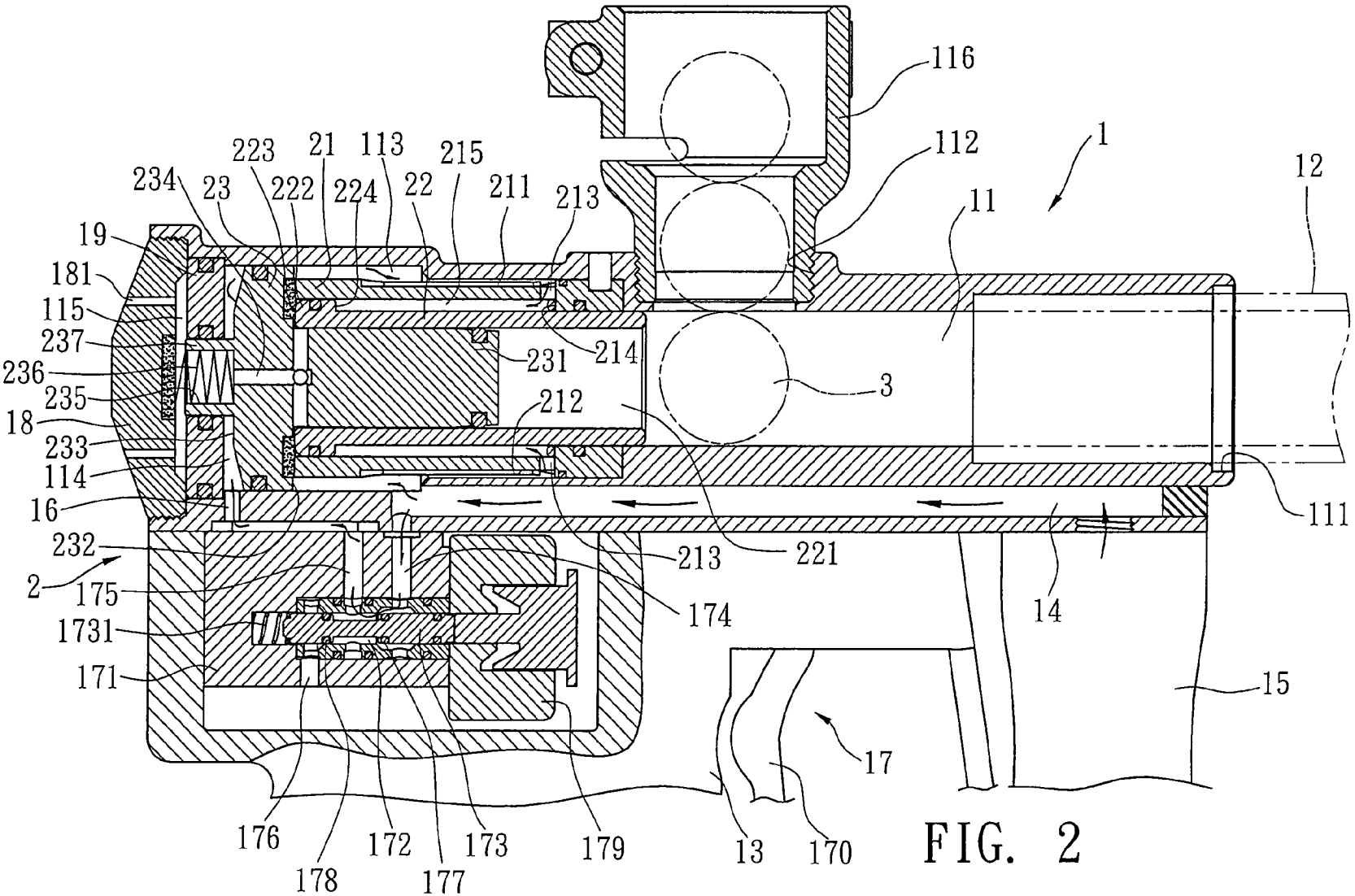
FIG. 2 is an enlarged sectional view of a part of the present invention.

Please refer to FIGS. 1 and 2. The shooting structure of the paint bullet gun of the present invention is arranged in a gun body 1 of the paint bullet gun.

The gun body 1 is formed with an axial passage 11. A first end of the passage 11 is closed, while a second end of the passage 11 has an exit 111 for connecting with a barrel 12. In this embodiment, the first end of the passage 11 is sealed with a rear cap 18. The gun body 1 is formed with a bullet-dropping port 112 near the exit 111. The bullet-dropping port 112 communicates with the passage 11. A paint bullet 3 can be loaded into a magazine 116 and dropped through the bullet-dropping port 112 into the passage 11. The shooting structure 2 is arranged in the passage 11 on a first side of the bullet-dropping port 112 distal from the exit 111 for shooting the paint bullet 3 dropping into the passage 11. A handle 13 is arranged on one side of the gun body 1. A trigger unit 17 is disposed in the handle 13 for controlling the shooting structure 2 to shoot the paint bullet 3.

The shooting structure 2 includes a tubular member 21, a gunlock 22 accommodated in the tubular member 21 and a controlling member 23 for controlling the gunlock 22.

The tubular member 21 is disposed in the passage 11 on the first side of the bullet-dropping port 112 distal from the exit 111. Both ends of the tubular member 21 communicate with the passage 11. In the passage 11, a gas reservoir 113 is defined around the tubular member 21. The gas reservoir 113 communicates with the interior of the tubular member 21 via flow ways 211. The gas reservoir 113 further communicates with a gas supply 4, whereby the high-pressure gas can go from the gas supply 4 into the gas reservoir 113 and then go through the flow way 211 into the tubular member 21. In this embodiment, a pipeline 14 is disposed in the gun body 1. A first end of the pipeline 14 communicates with the gas reservoir 113, while a second end of the pipeline 14 is connected with a regulating valve 15. The regulating valve 15 is connected with the gas supply 4. The outer circumference of the tubular member 21 is formed with two channels 212. First ends of the channels 212 extend to the gas reservoir 113. Second ends of the channels 212 communicate with radial through holes 213 which communicate with the interior of the tubular member 21. Accordingly, the channels 212 and the through holes 213 together form the flow ways 211 communicating the gas reservoir 113 with the interior of the tubular member 21.

The gunlock 22 is axially movably accommodated in the tubular member 21. The gunlock 22 is formed with an exhaust duct 221 axially passing through the gunlock 22. An opening of a second end of the exhaust duct 221 communicates with the passage 11 of the gun body 1, while an opening of a first end of the exhaust duct 221 can communicate with the gas reservoir 113. A first end of the gunlock 22 is formed with a flange 222 proximal to the gas reservoir 113. A first side of the flange 222 has a first pushing face 223, while a second side of the flange 222 has a second pushing face 224. Due to the flange 222, a space 215 is defined between an outer circumference of the gunlock 22 and the inner circumference of the tubular member 21. The flow ways 211 communicate with the space 215. A second end of the tubular member 21 distal from the flange 222 of the gunlock 22 is equipped with a stopper section 214 for stopping the gunlock 22 from detaching from the tubular member 21.

The controlling member 23 is positioned at the first end of the tubular member 21. The controlling member 23 has a guide stem 231 extending toward the exhaust duct 221 of the gunlock 22. The guide stem 231 is formed with an escape duct 234 communicating with outer side of the gun body 1. In addition, the controlling member 23 has a stopper face 232 for stopping the first end of the tubular member 21. The controlling member 23 further has a forced face 233 opposite to the stopper face 232. The forced face 233 partitions the gas reservoir 113 of the passage 11 into an intake room 114. The gun body 1 is formed with an intake 16 communicating with the intake room 114. The gas can go from the gas supply 4 through the intake 16 into the intake room 114 to drive and push the controlling member 23. The trigger unit 17 controls whether the gas of the gas supply 4 can go from the gas supply 4 through the intake 16 into the intake room 114 or not.

In this embodiment, the trigger unit 17 includes a valve assembly including a valve housing 171 and a trigger 170 for controlling the valve assembly. The valve housing 171 is disposed in the handle 13. The valve housing 171 has an internal chamber 172 in which a valve rod 173 is mounted. The valve housing 171 is formed with a first ventiduct 174, a second ventiduct 175 and an exhaust port 176 communicating with the chamber 172. The first ventiduct 174 communicates with the pipeline 14 of the gun body 1, permitting the air of the gas supply 4 to enter the chamber 172. The second ventiduct 175 communicates with the intake 16, permitting the gas to go from the chamber 172 into the intake room 114. The valve rod 173 has a first plug section 177 and a second plug section 178 respectively corresponding to two sides of the second ventiduct 175. The valve rod 173 is controlled by the trigger 170 and axially movable, whereby the first plug section 177 controls the communication between the first ventiduct 174 and the second ventiduct 175 and the second plug section 178 can block the exhaust port 176. In this embodiment, a spring 1731 is disposed at a first end of the valve rod 173 for pushing the valve rod 173 to protrude a second end of the valve rod 173 from the valve housing 171. An electromagnet 179 is disposed at the second end of the valve rod 173 and controlled by the trigger 170 to drive and axially move the valve rod 173 back and forth.

In order to help to move the controlling member 23, in this embodiment, a boss 237 axially projects from the forced face 233 of the controlling member 23. A cock block 19 is disposed in the passage 11 of the gun body 1 corresponding to the boss 237. The boss 237 is fitted in the cock block 19. The intake room 114 is defined between the cock block 19 and the forced face 233 of the controlling member 23. The boss 237 has an internal cavity 235 in which a spring 236 is disposed. One end of the spring 236 abuts against a bottom of the cavity 235, while the other end of the spring 236 abuts against the rear cap 18 for providing a push force to the controlling member 23.

In order to communicate the escape duct 234 of the guide stem 231 with outer side of the gun body 1, the escape duct 234 communicates with the cavity 235 of the boss 237. A gap 151 is defined between the cock block 19 and the rear cap 18. The rear cap 18 is formed with several exhaustion ducts 181 communicating the gap 115 with outer side of the rear cap 18. Accordingly, the waste gas entering the escape duct 234 can flow through the cavity 235 into the gap 115 and then flow through the exhaustion dusts 181 to be exhausted from the rear cap 18.

In normal state, that is, a ready state as shown in FIG. 2, the valve rod 173 of the trigger unit 17 is not controlled by the trigger 170. The first plug section 177 of the valve rod 173 permits the first ventiduct 174 to communicate with the second ventiduct 175. Under such circumstance, the gas goes from the gas supply 4 through the first ventiduct 174 and the second ventiduct 175 into the intake room 114 to drive and move the controlling member 23 toward the tubular member 21. At this time, the stopper face 232 of the controlling member 23 abuts against the tubular member 21 and blocks the gas reservoir 113. The gas flows from the gas reservoir 113 through the flow ways 211 into the internal space 215 of the tubular member 21 to push the second push face 224 of the flange 222 of the gunlock 22. Accordingly, the gunlock 22 is retreated to open the bullet-dropping port 112, permitting a paint bullet 3 to drop into the passage 11 in front of the gunlock 22 in a ready state.

Figure 3:
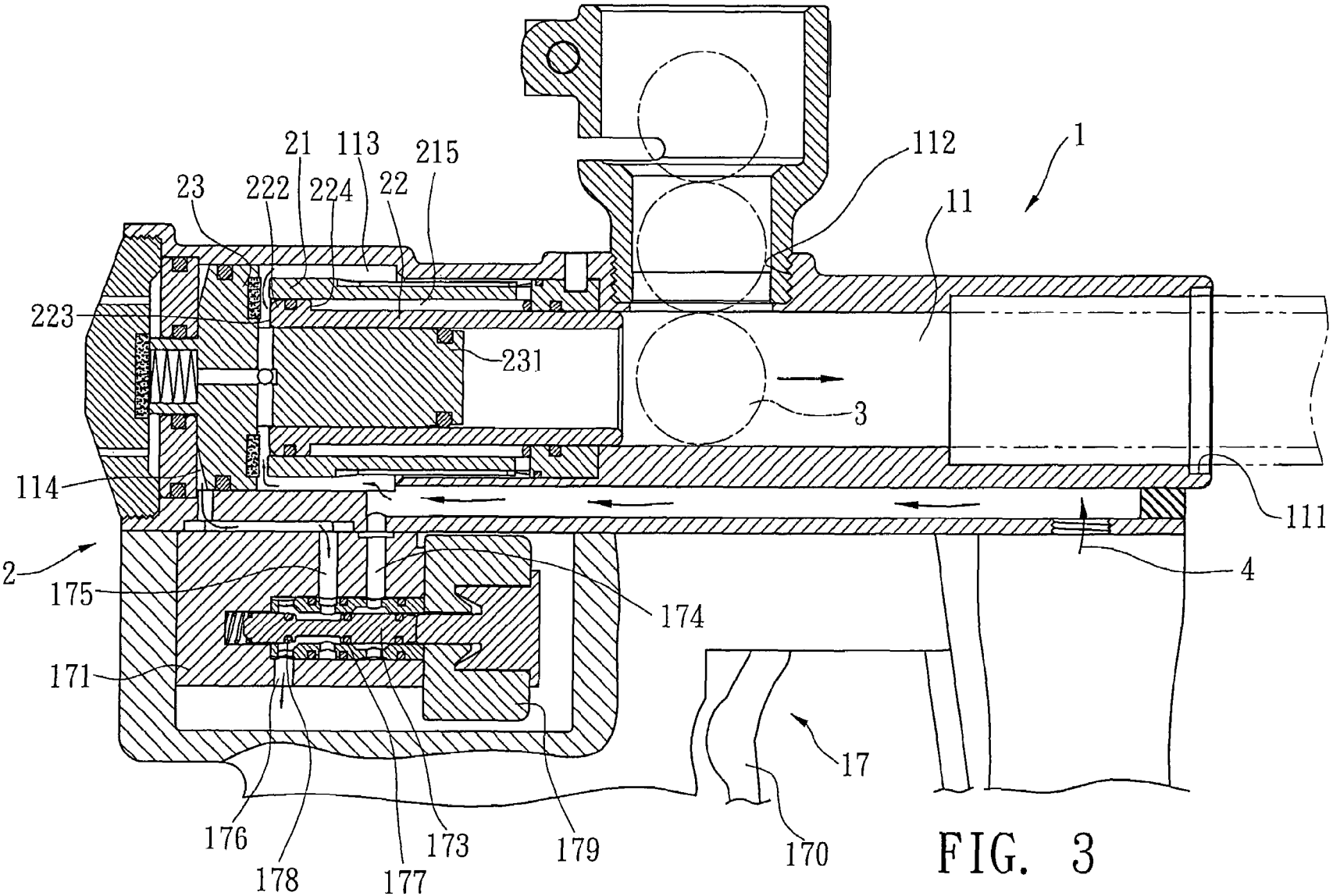
FIG. 3 is a sectional view according to FIG. 2, showing that the gunlock is ready to shoot a paint bullet.
Figure 4:
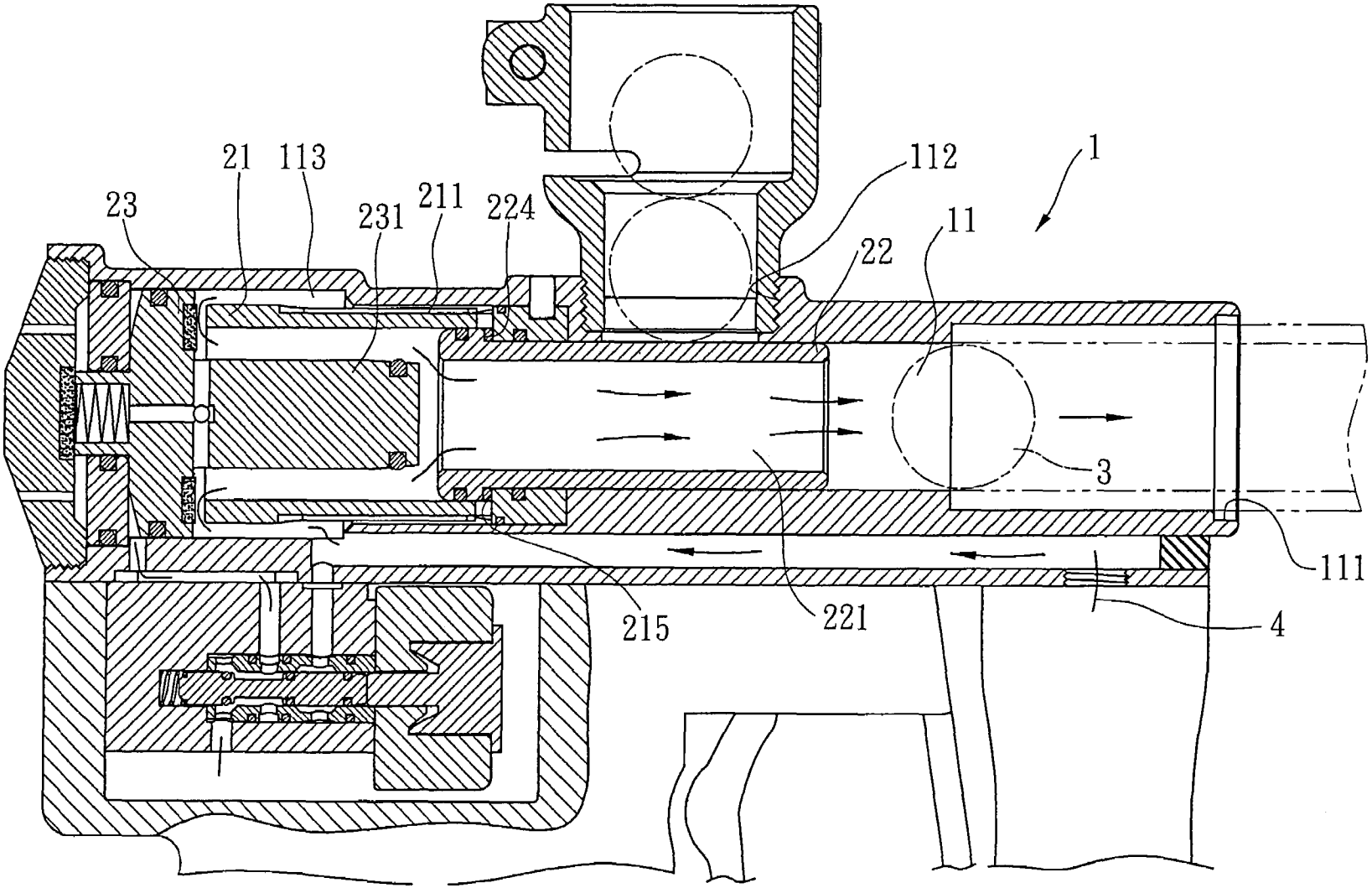
FIG. 4 is a sectional view according to FIG. 2, showing that the gunlock shoots the paint bullet.

When pulling the trigger 170 of the trigger unit 17 as shown in FIG. 3, the electromagnet 179 will drive and move the valve rod 173, whereby the first plug section 177 of the valve rod 173 shuts off the communication between the first ventiduct 174 and the second ventiduct 175, whereby the gas of the gas supply 4 no more enters the intake room 114. At the same time, the second plug section 178 of the valve rod 173 will unblock the exhaust port 176 to exhaust the gas from the intake room 114. At this time, the controlling member 23 will retreat due to the gas pressure of the gas reservoir 113, permits the gas reservoir 113 to communicate with the internal space of the tubular member 21. At this time, the gas pressure of the gas reservoir 113 will push the first push face 223 of the flange 222 of the gunlock 22 to move the gunlock 22 forward toward the exit 111 of the passage 11 to close the bullet-dropping port 112 and separate from the guide stem 231 of the controlling member 23 as shown in FIG. 4. At this time, the gas goes from the gas supply 4 through the gas reservoir 113 into the tubular member 21 and goes into the exhaust duct 221 of the gunlock 22 to be exhausted from the exhausted duct 221 for shooting the paint bullet 3 in front of the gunlock 22. When the gunlock 22 is moved forward, the second push face 224 of the flange 222 will compress and push the gas flowing from the flow ways 211 into the internal space 215 of the tubular member 21 back to the gas reservoir 113.

Figure 5:
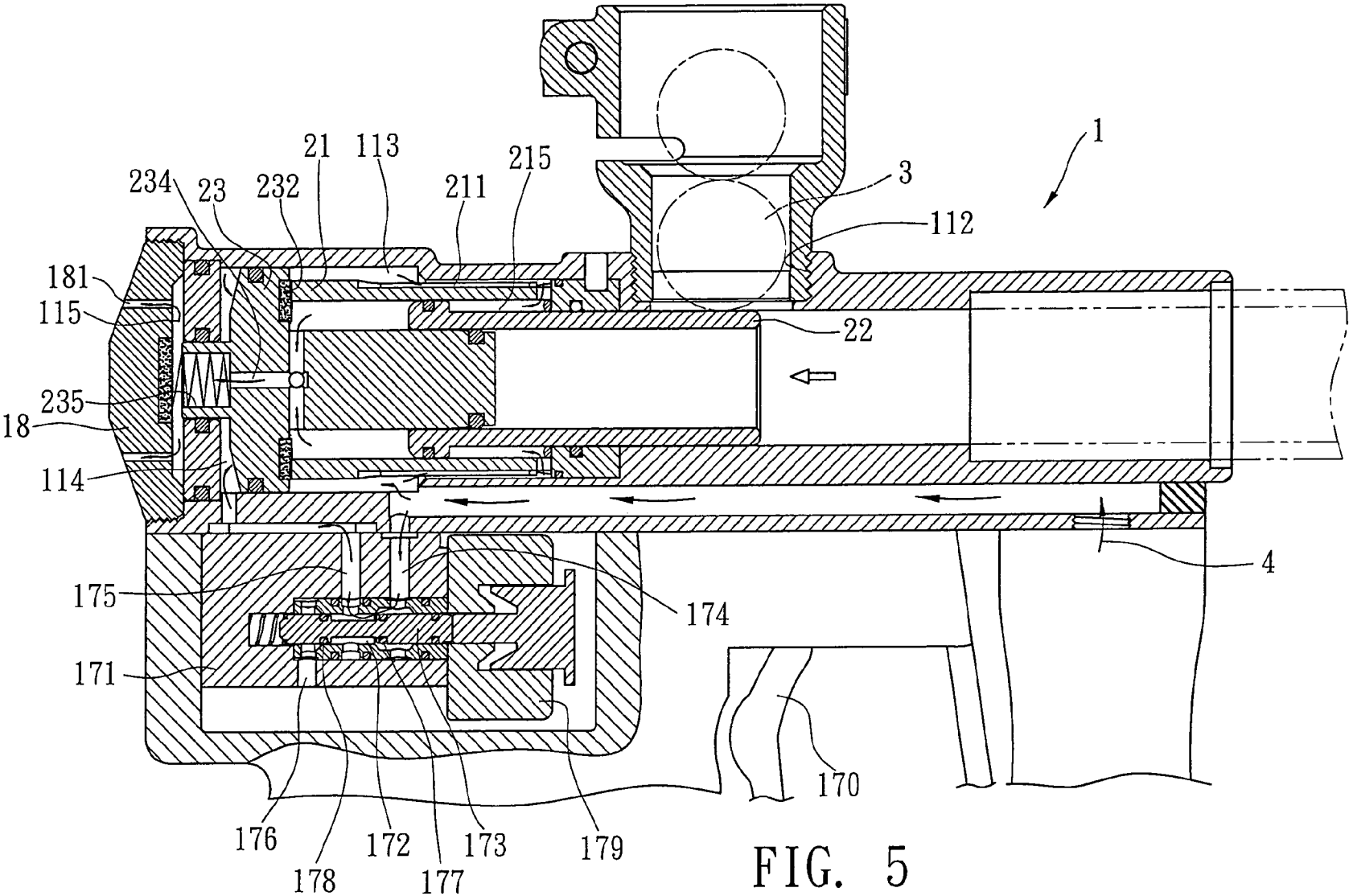
FIG. 5 is a sectional view according to FIG. 2, showing that the gunlock is restored to its home position after shooting the paint bullet.
Figure 6:
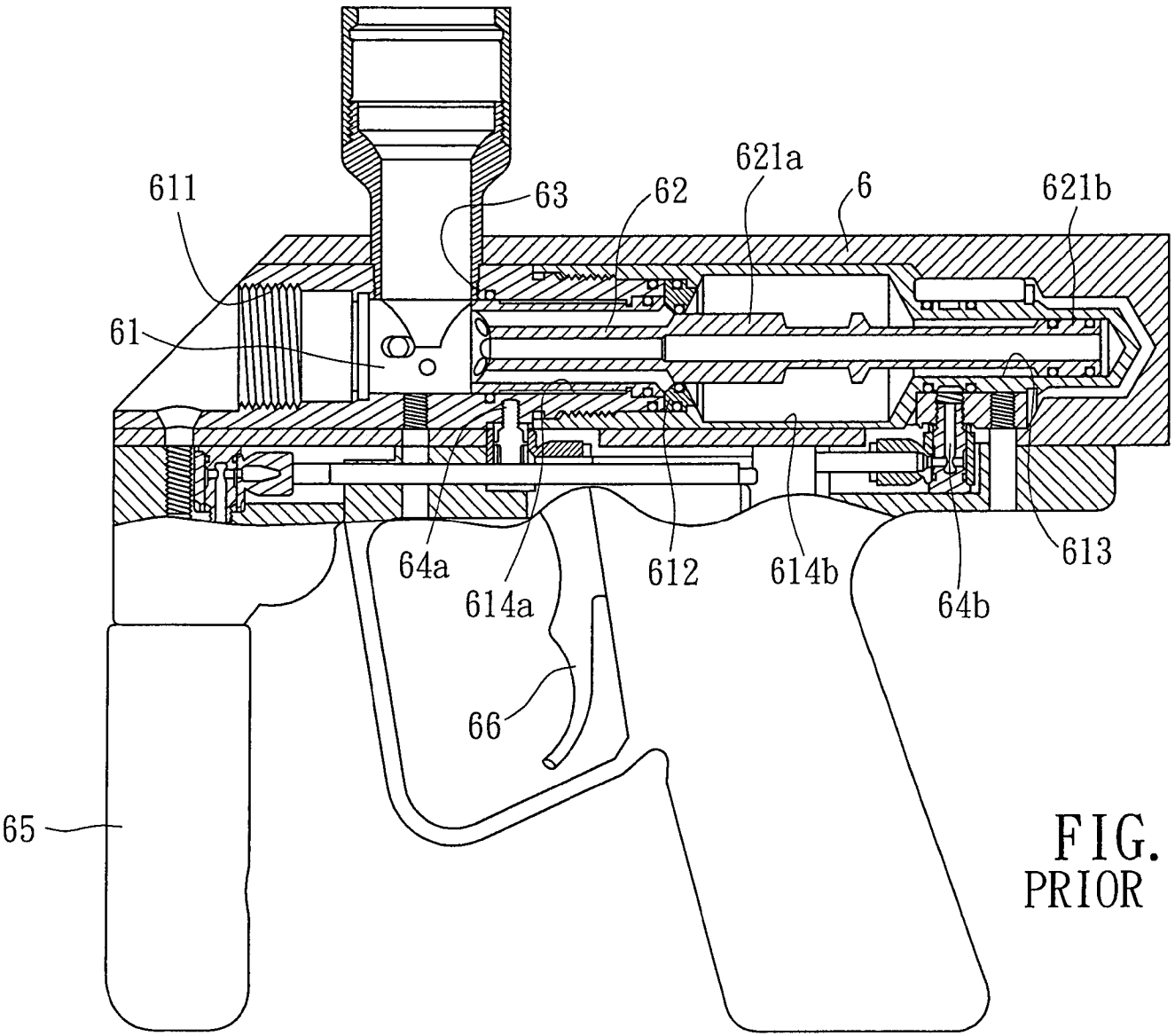
FIG. 6 PRIOR ART
FIG. 6 is a sectional view of a conventional paint bullet gun.

After the paint bullet 3 is shot, the valve rod 173 is restored to its home position by the spring 1731. At this time, the first plug section 177 of the valve rod 173 again permits the first ventiduct 174 to communicate with the second ventiduct 175 and the second plug section 178 of the valve rod 173 blocks the exhaust port 176. The gas can go from the gas supply 4 into the intake room 114 to push and restore the controlling member 23 to its home position. At this time, the stopper face 232 of the controlling member 23 abuts against the tubular member 21 to shut off the communication between the internal space of the tubular member 21 and the gas reservoir 113. Under such circumstance, the gas flows from the gas reservoir 113 through the flow ways 211 into the internal space 215 of the tubular member 21 to again retreat the gunlock 22 as shown in FIG. 5. At this time, the bullet-dropping port 112 is again opened and the next bullet 3 drops into the passage 11 in front of the gunlock 22 in a ready state for the next shot. When the gunlock 22 is retreated, the gas in the tubular member 21 flows through the escape duct 234 and the cavity 235 and the gap 115 to be exhausted from the exhaustion ducts 181.

According to the above arrangements, the gas reservoir 113 communicates with the internal space 215 of the tubular member 21 via the flow ways 211. Therefore, the gas entering the gas reservoir 113 also serves to drive the gunlock 22. Accordingly, it is no more necessary to add another gas supply for driving the gunlock. In addition, when the gunlock 22 is moved forward, the second push face 224 of the flange 222 of the gunlock 22 will compress and push the gas flowing into the internal space 215 of the tubular member 21 back to the gas reservoir 113. Therefore, the gas can be recovered and reused to increase the number of the shot paint bullets.

Moreover, the guide stem 231 of the controlling member 23 extends into the gunlock 22, whereby the gunlock 22 can axially move along the guide stem 231 to shorten the necessary axial moving space for the gunlock 22. Therefore, the length of the gun body 1 can be shortened to facilitate holding of the paint bullet gun. Such length is applicable to a handgun.

The above embodiments are only used to illustrate the present invention, not intended to limit the scope thereof. Many modifications of the above embodiments can be made without departing from the spirit of the present invention.

What is claimed is:

1. A shooting structure of a paint bullet gun, which is arranged in a gun body of the paint bullet gun, wherein:

the gun body is formed with an axial passage, a first end of the passage being closed, while a second end of the passage having an exit for connecting with a barrel, the gun body being formed with a bullet-dropping port near the exit, the bullet-dropping port communicating with the passage, whereby a paint bullet can be loaded into a magazine and dropped through the bullet-dropping port into the passage, the shooting structure being arranged in the passage on a first side of the bullet-dropping port distal from the exit for shooting the paint bullet dropping into the passage, a handle being arranged on one side of the gun body, a trigger unit being disposed in the handle for controlling the shooting structure to shoot the paint bullet; and the shooting structure includes a tubular member, a gunlock accommodated in the tubular member and a controlling member for controlling the gunlock, the tubular member being disposed in the passage on the first side of the bullet-dropping port distal from the exit, both ends of the tubular member communicating with the passage, in the passage, a gas reservoir being defined around the tubular member, the gas reservoir communicating with the interior of the tubular member via flow ways, the gas reservoir further communicating with a gas supply via a pipeline, whereby high-pressure gas can go from the gas supply into the gas reservoir and then go through the flow way into the tubular member, the gunlock being axially movably accommodated in the tubular member, the gunlock being formed with an exhaust duct axially passing through the gunlock, an opening of a second end of the exhaust duct communicating with the passage of the gun body, while an opening of a first end of the exhaust duct can communicate with the gas reservoir, a first end of the gunlock being formed with a flange proximal to the gas reservoir, a first side of the flange having a first pushing face, while a second side of the flange having a second pushing face, due to the flange, a space being defined between an outer circumference of the gunlock and an inner circumference of the tubular member, the flow ways communicating with the space, a second end of the tubular member distal from the flange of the gunlock being equipped with a stopper section for stopping the gunlock from detaching from the tubular member, the controlling member being positioned at the first end of the tubular member, the controlling member having a guide stem extending toward the exhaust duct of the gunlock, the guide stem being formed with an escape duct communicating with an outer side of the gun body, the controlling member having a stopper face for stopping the first end of the tubular member, the controlling member further having a forced face opposite to the stopper face, the forced face partitioning the gas reservoir of the passage into an intake room, the gun body being formed with an intake communicating with the intake room, whereby the gas can go from the gas supply through the intake into the intake room to drive and push the controlling member, the trigger unit serving to control whether the gas of the gas supply can go from the gas supply into the intake room or not.

2. The shooting structure of the paint bullet gun as claimed in claim 1, wherein the trigger unit includes a valve assembly including a valve housing and a trigger for controlling the valve assembly, the valve housing being disposed in the handle, the valve housing having an internal chamber in which a valve rod is mounted, the valve housing being formed with a first ventiduct, a second ventiduct and an exhaust port communicating with the chamber, the first ventiduct communicating with the pipeline of the gun body, permitting the air of the gas supply to enter the chamber, the second ventiduct communicating with the intake, permitting the gas to go from the chamber into the intake room, the valve rod having a first plug section and a second plug section respectively corresponding to two sides of the second ventiduct, the valve rod being controlled by the trigger and axially movable, whereby the first plug section controls the communication between the first ventiduct and the second ventiduct and the second plug section can block the exhaust port.

3. The shooting structure of the paint bullet gun as claimed in claim 2, wherein a spring is disposed at a first end of the valve rod for pushing the valve rod to protrude a second end of the valve rod from the valve housing, an electromagnet being disposed at the second end of the valve rod and controlled by the trigger to drive and axially move the valve rod back and forth.

4. The shooting structure of the paint bullet gun as claimed in claim 1, wherein the pipeline is disposed in the gun body, a first end of the pipeline communicating with the gas reservoir, while a second end of the pipeline being connected with a regulating valve, the regulating valve being connected with the gas supply, an outer circumference of the tubular member being formed with two channels, first ends of the channels extending to the gas reservoir, second ends of the channels communicating with radial through holes which communicate with the space between the tubular member and the gunlock, whereby the channels and the through holes together form the flow ways communicating the gas reservoir with the interior of the tubular member.

5. The shooting structure of the paint bullet gun as claimed in claim 1, wherein the first end of the passage is sealed with a rear cap, a boss axially projecting from the forced face of the controlling member, a cock block being disposed in the passage of the gun body corresponding to the boss, the boss being fitted in the cock block, the intake room being defined between the cock block and the forced face of the controlling member, the boss having an internal cavity in which a spring is disposed, one end of the spring abutting against a bottom of the cavity, while the other end of the spring abutting against the rear cap for providing a push force to the controlling member.

6. The shooting structure of the paint bullet gun as claimed in claim 5, wherein the escape duct of the guide stem communicates with the cavity of the boss, a gap being defined between the cock block and the rear cap, the rear cap being formed with several exhaustion ducts communicating the gap with outer side of the rear cap, whereby the waste gas entering the escape duct can flow through the cavity into the gap and then flow through the exhaustion dusts to be exhausted from the rear cap.

* * * * *